US011179588B2

(12) United States Patent
McCall

(10) Patent No.: US 11,179,588 B2
(45) Date of Patent: Nov. 23, 2021

(54) ADJUSTABLE SLEDGEHAMMER WORKOUT APPARATUS

(71) Applicant: Shannon H. McCall, Laceys Spring, AL (US)

(72) Inventor: Shannon H. McCall, Laceys Spring, AL (US)

( * ) Notice: Subject to any disclaimer, the term of this patent is extended or adjusted under 35 U.S.C. 154(b) by 53 days.

(21) Appl. No.: 16/544,377

(22) Filed: Aug. 19, 2019

(65) Prior Publication Data

US 2019/0366143 A1 Dec. 5, 2019

Related U.S. Application Data

(63) Continuation-in-part of application No. 15/465,595, filed on Mar. 21, 2017, now Pat. No. 10,610,721.
(Continued)

(51) Int. Cl.
*A63B 15/00* (2006.01)
*A63B 21/00* (2006.01)
*A63B 21/072* (2006.01)

(52) U.S. Cl.
CPC ..... *A63B 15/00* (2013.01); *A63B 21/0728* (2013.01); *A63B 21/4035* (2015.10); *A63B 21/0726* (2013.01)

(58) Field of Classification Search
CPC ..... A63B 15/00; A63B 21/0004; A63B 21/00058; A63B 21/00061; A63B 21/00065; A63B 21/00069; A63B 21/00072; A63B 21/00185; A63B 21/0608; A63B 21/068; A63B 21/072; A63B 21/0722; A63B 21/0724; A63B 21/0726; A63B 21/0728; A63B 21/075;
(Continued)

(56) References Cited

U.S. PATENT DOCUMENTS 3,351,346 A * 11/1967 Strahan ..... A63B 15/00 473/256
D247,919 S * 5/1978 Goyette, Jr. ..... A63B 21/0608 D21/791
(Continued)

OTHER PUBLICATIONS http://www.roguefitness.com:80/strongman/accessories/hammers; one page, Jan. 21, 2016.
(Continued)

*Primary Examiner* — Gary D Urbiel Goldner
(74) *Attorney, Agent, or Firm* — Waller Lansden Dortch & Davis, LLP; Blake M. Bernard

(57) ABSTRACT

An adjustable sledgehammer workout apparatus may include a handle, and a clamping assembly connected to the handle. The clamping assembly can include an upper portion and a lower portion, the lower portion connected to a first end of the handle, the clamping assembly operable to releasably clamp a dumbbell between the upper and lower portions of the clamping assembly. The clamping assembly can include a first clamping subassembly operable to apply a clamping force on the upper and lower portions of the clamping assembly. The clamping assembly can further include a second clamping subassembly engageable with the first clamping subassembly, the second clamping subassembly operable to increase the clamping force applied by the first clamping subassembly on the upper and lower portions of the clamping assembly.

16 Claims, 15 Drawing Sheets

Related U.S. Application Data

(60) Provisional application No. 62/310,897, filed on Mar. 21, 2016, provisional application No. 62/719,447, filed on Aug. 17, 2018.

(58) Field of Classification Search
CPC ..... A63B 21/08; A63B 21/15; A63B 21/159; A63B 21/16; A63B 21/4023; A63B 21/4027; A63B 21/4033; A63B 21/4035; A63B 21/4043; A63B 23/12; A63B 23/1209; A63B 23/1245; A63B 23/1281; A63B 23/129; A63B 65/00; A63B 65/04; A63B 2244/09; A63B 2244/17
See application file for complete search history.

(56) References Cited

U.S. PATENT DOCUMENTS

| | | | | |
|---|---|---|---|---|
| 4,506,885 | A | 3/1985 | de Wet | |
| 4,602,788 | A | 7/1986 | Wendt | |
| D352,985 | S * | 11/1994 | Eno | A63B 15/00 D21/791 |
| 5,496,243 | A | 3/1996 | Allen | |
| D428,461 | S * | 7/2000 | Koszalinski | D21/791 |
| 6,902,517 | B1 | 6/2005 | Brown et al. | |
| D573,670 | S * | 7/2008 | Mullins | D21/679 |
| D578,176 | S * | 10/2008 | Brooks | D21/791 |
| 8,267,841 | B1 | 9/2012 | Allison et al. | |
| 8,684,889 | B1 | 4/2014 | Berrisford | |
| 10,610,721 | B2 * | 4/2020 | McCall | A63B 21/0608 |
| 2009/0152783 | A1 | 6/2009 | Sigler et al. | |
| 2011/0177922 | A1 | 7/2011 | Selinger | |
| 2012/0149539 | A1 | 6/2012 | Quader | |
| 2012/0252641 | A1 | 10/2012 | Odneal et al. | |
| 2013/0244842 | A1 | 9/2013 | Henley | |
| 2014/0018214 | A1 | 1/2014 | Jordan | |
| 2014/0024506 | A1 | 1/2014 | Vixathep | |
| 2014/0051554 | A1 | 2/2014 | Walker | |
| 2014/0135186 | A1 | 5/2014 | Reynolds et al. | |
| 2015/0105224 | A1 | 4/2015 | Odneal et al. | |
| 2016/0096057 | A1 | 4/2016 | Gavigan | |
| 2017/0095687 | A1 | 4/2017 | Sonnon et al. | |
| 2017/0266479 | A1 * | 9/2017 | McCall | A63B 21/0726 |

OTHER PUBLICATIONS http://www.roguefitness.com:80/sisu-war-hammer; three pages, Jan. 21, 2016.

http://www.roguefitness.com:80/slater-slammer; four pages, Jan. 21, 2016.

http://www.roguefitness.com:80/kabuki-strength-shoulderok; four pages, Jan. 21, 2016.

* cited by examiner

ADJUSTABLE SLEDGEHAMMER WORKOUT APPARATUS

CROSS-REFERENCES TO RELATED APPLICATIONS

This application is a continuation-in-part of U.S. patent application Ser. No. 15/465,595 filed Mar. 21, 2017 entitled ADJUSTABLE SLEDGEHAMMER WORKOUT APPARATUS, which is a non-provisional of 62/310,897 filed Mar. 21, 2016 entitled ADJUSTABLE SLEDGEHAMMER WORKOUT APPARATUS, and this application is a non-provisional of U.S. Patent Application No. 62/719,447 filed Aug. 17, 2018 entitled ADJUSTABLE SLEDGEHAMMER WORKOUT APPARATUS, each of which is hereby incorporated by reference herein in their entireties.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present disclosure relates generally to workout equipment. More particularly, the present disclosure relates to an adjustable sledgehammer workout apparatus.

Sledgehammer workouts are well known in the art and generally involve an individual swinging and striking a rubber tire with a sledgehammer. Sledgehammers for this purpose are available in a variety of weights and individuals must purchase different weighted sledgehammers in order to vary the weight they are using during a workout. Purchasing multiple different weighted sledgehammers, however, can be expensive and undesirable in some cases. In addition, storing multiple different weighted sledgehammers can be inconvenient for some individuals.

BRIEF SUMMARY

The present invention is directed to an adjustable sledgehammer workout apparatus that can be used by an individual to create a sledgehammer and to vary the weight of that sledgehammer as desired. As a result, individuals do not need to purchase and store multiple different weighted sledgehammers.

In one exemplary embodiment, an adjustable sledgehammer workout apparatus is disclose which may include a handle, and a clamping assembly connected to the handle. The clamping assembly can include an upper portion and a lower portion, the lower portion connected to a first end of the handle, the clamping assembly operable to releasably clamp the dumbbell between the upper and lower portions of the clamping assembly. The clamping assembly can include a first clamping subassembly operable to apply a clamping force on the upper and lower portions of the clamping assembly. The clamping assembly can further include a second clamping subassembly engageable with the first clamping subassembly, the second clamping subassembly operable to increase the clamping force applied by the first clamping subassembly on the upper and lower portions of the clamping assembly.

Numerous other objects, advantages and features of the present disclosure will be readily apparent to those of skill in the art upon a review of the following drawings and description of a preferred embodiment.

DETAILED DESCRIPTION

Figure 2:
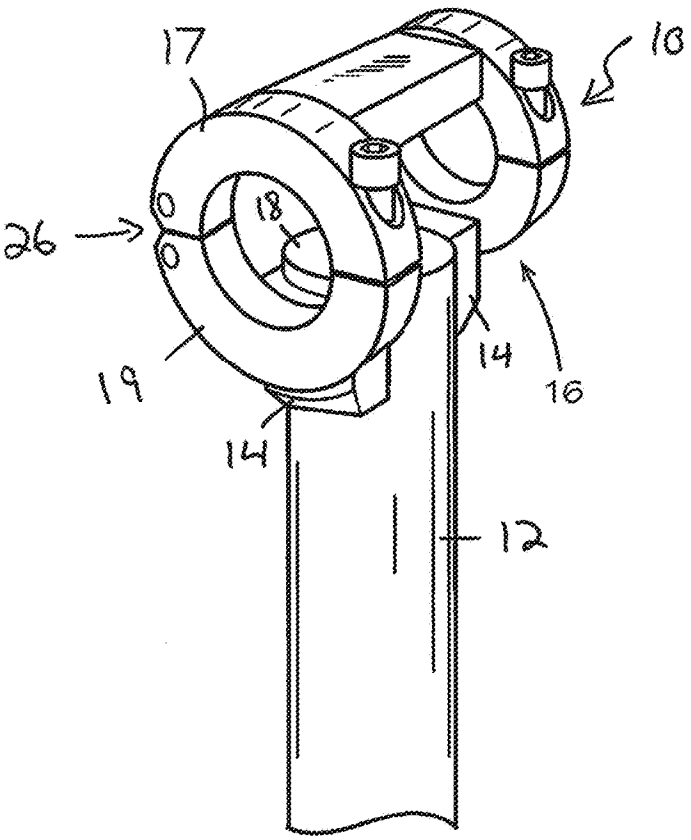
FIGS. 1-6 are perspective views showing one embodiment of the present invention.
Figure 1:
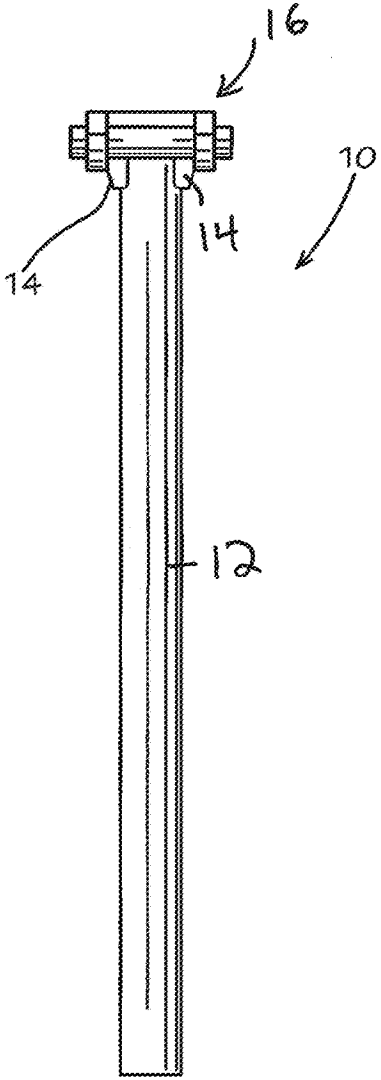

While the making and using of various embodiments of the present invention are discussed in detail below, it should be appreciated that the present invention provides many applicable inventive concepts that are embodied in a wide variety of specific contexts. The specific embodiments discussed herein are merely illustrative of specific ways to make and use the invention and do not delimit the scope of the invention. Those of ordinary skill in the art will recognize numerous equivalents to the specific apparatus and methods described herein. Such equivalents are considered to be within the scope of this invention and are covered by the claims.

In the drawings, not all reference numbers are included in each drawing, for the sake of clarity. In addition, positional terms such as "upper," "lower," "side," "top," "bottom," etc. refer to the apparatus when in the orientation shown in the drawing. A person of skill in the art will recognize that the apparatus can assume different orientations when in use.

Figure 4:
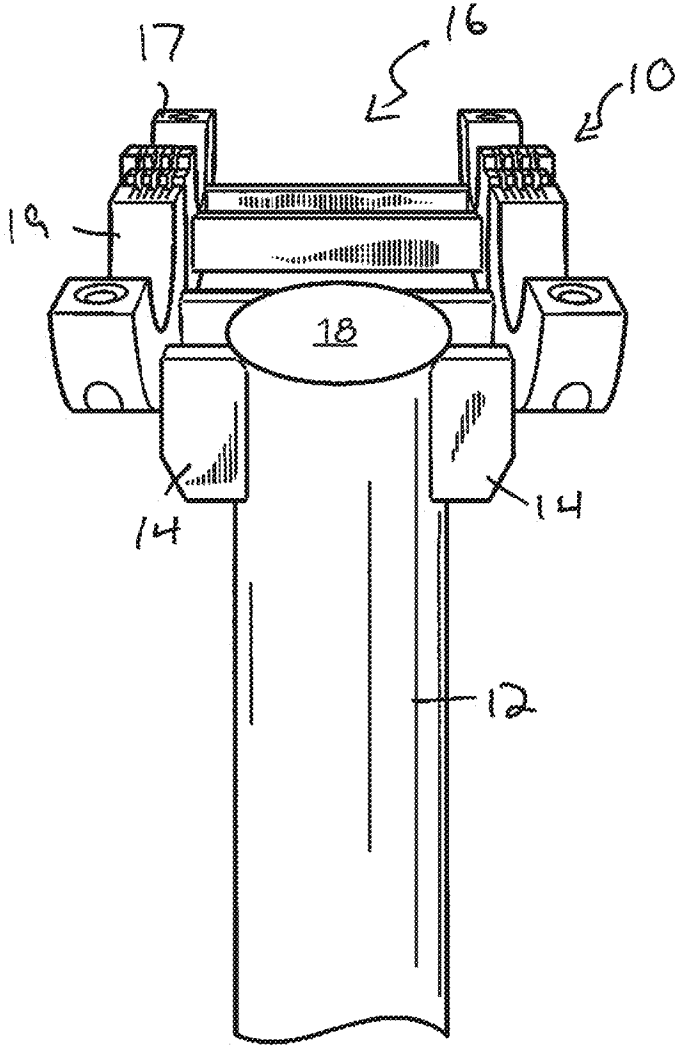

Referring to FIGS. 1-6, one embodiment of the adjustable sledgehammer workout apparatus 10 of the present invention may include a handle 12, a pair of supporting brackets 14 connected to an upper portion of the handle 12, and a clamping assembly 16 connected to the supporting brackets 14. The handle 12 may be 3 feet long but may vary in length in other embodiments. The handle 12 may be manufactured out of steel or any other material suitable for supporting the loads applied to the handle 12. The handle 12 may be hollow and may include end caps 18 (FIG. 4).

Figure 3:
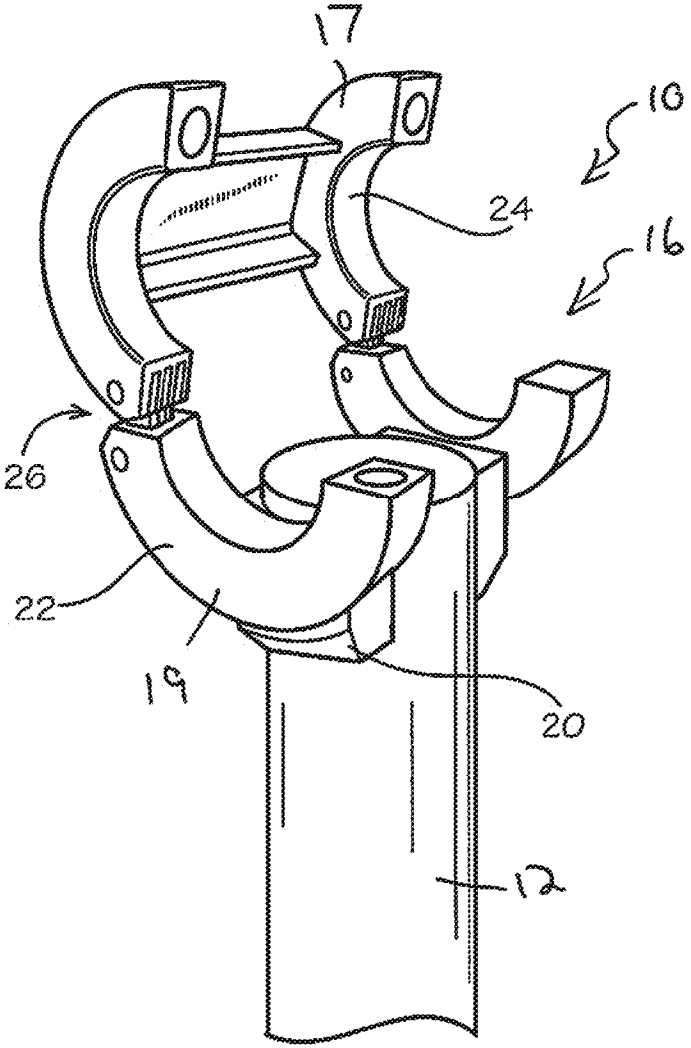
Figure 6:
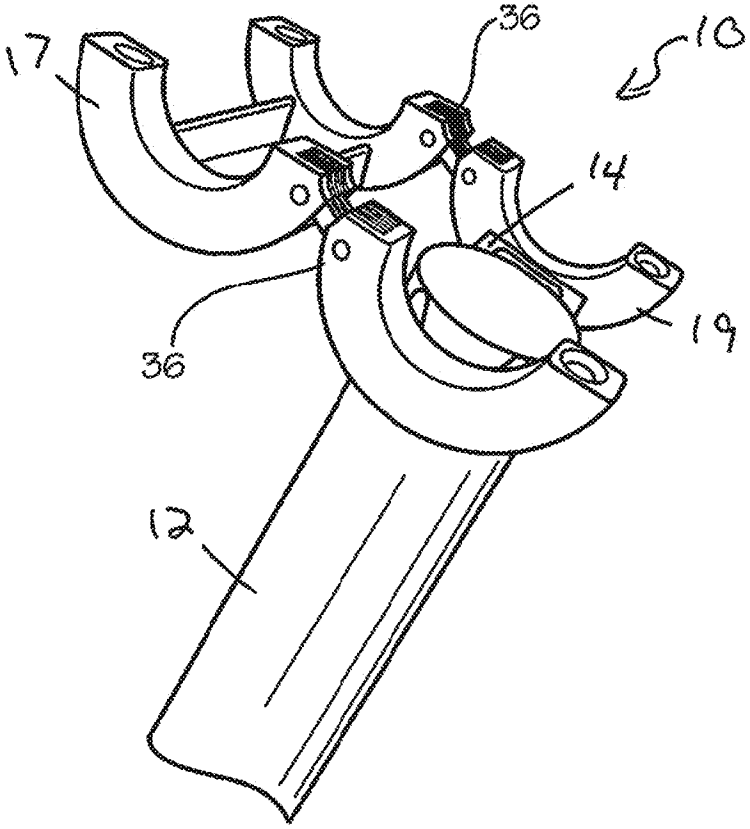
Figure 5:
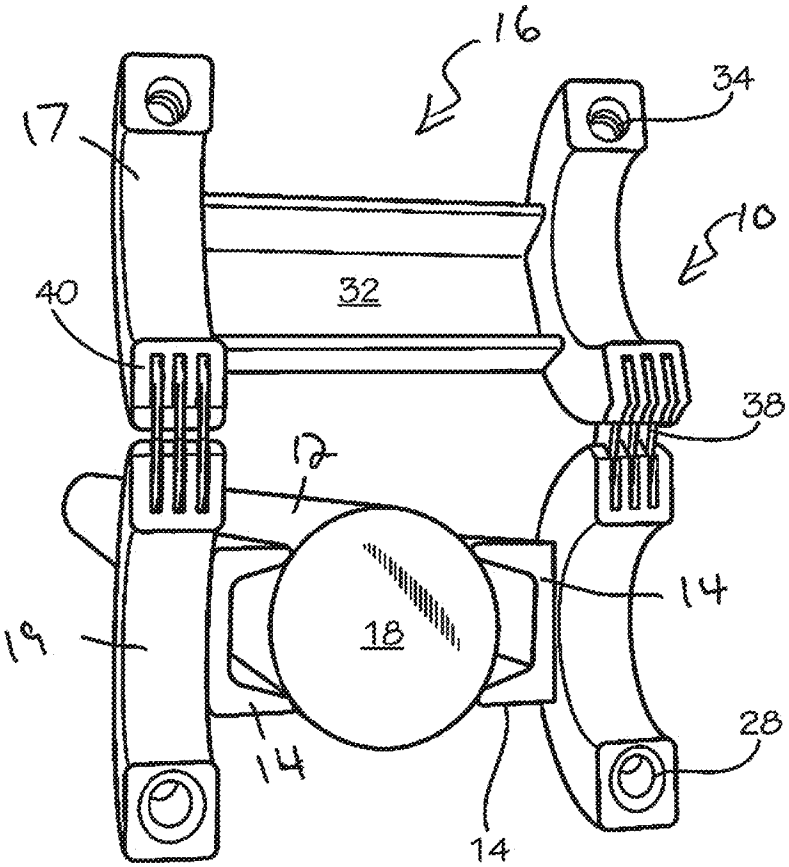

The supporting brackets 14 may be welded to the upper portion of the handle 12 and may be rectangular in shape with beveled or rounded edges 20 (FIG. 3). The supporting brackets 14 may also be manufactured out of steel or another suitable material. The supporting brackets 14 may be u-shaped as shown in FIG. 5 or solid blocks of material.

Figure 7:
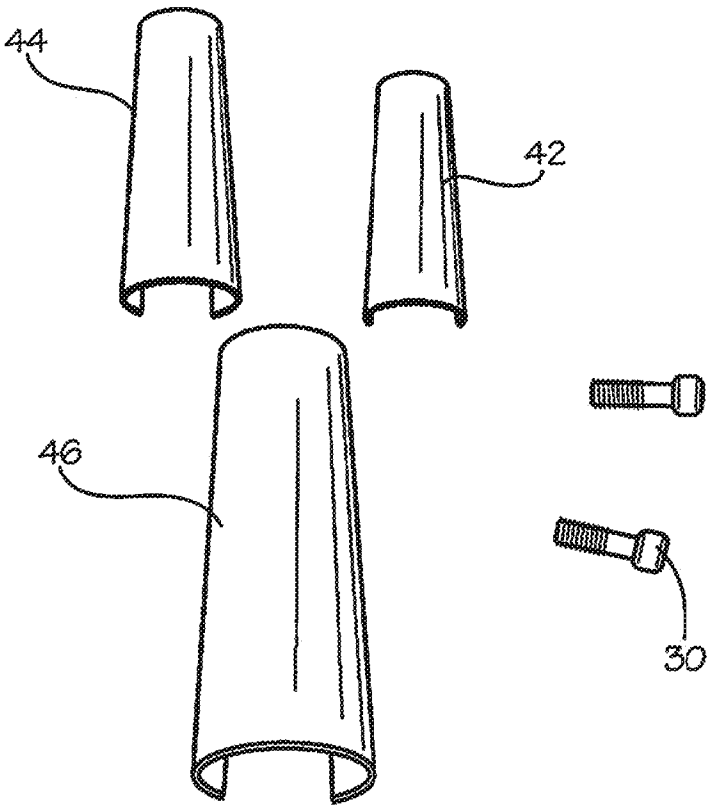
FIG. 7 is a perspective view showing another embodiment rubber pads and threaded bolts used with the present invention.

The clamping assembly 16 (FIG. 3) may include a pair of lower c-shaped portions 22 connected to a pair of upper c-shaped portion 24 using a hinge assembly 26, all of which may be manufactured out of steel or another suitable material. The clamping assembly 16 may be welded to the supporting brackets 14. The lower c-shaped portions 22 may include threaded openings 28 (FIG. 5) for receiving threaded bolts 30 (FIG. 7). The threaded openings 28 may extend through the lower c-shaped portions 22.

The upper c-shaped portions 24 may be connected together using an elongated, u-shaped support 32, which may be welded to the upper c-shaped portions 24. The upper c-shaped portions 24 may include threaded openings 34 for receiving the threaded bolts 30. The threaded openings 34 may extend through the upper c-shaped portions 24.

The hinge assembly 26 may include a pair of hinge pins 36 (FIG. 6) disposed in the upper and lower c-shaped portions, 24 and 22, and three hinge arms 38 (FIG. 5) connected to the upper and lower c-shaped portions, 24 and 22, using the hinge pins 36. The upper and lower c-shaped portions, 24 and 22, may include notches 40 and the hinge arms 38 may be disposed in the notches 40. The hinge assembly 26 may allow the upper c-shaped portion 24 to pivot up, back, and down with respect to the lower c-shaped portion 22.

The apparatus 10 may include different sized rubber pads, 42, 44, and 46, (FIG. 7) which may be wrapped around dumbbells before they are placed in the clamping assembly 16.

The workout apparatus 10 may be used by removing threaded bolts 30 (which may be hex bolts), lifting the upper c-shaped portion 24 up (FIG. 3), placing a dumbbell in the lower c-shaped portion 22 (optionally wrapping the dumbbell with one or more rubber pads to ensure the dumbbell fits securely in the clamping assembly 16), closing the upper c-shaped portion 24 so that the threaded openings 28 and 34 are aligned, and then securing the upper and lower c-shaped portions, 24 and 22, together using the threaded bolts 30. A user can then exercise by swinging the workout apparatus 10 like a sledgehammer against a large tire.

Figure 8:
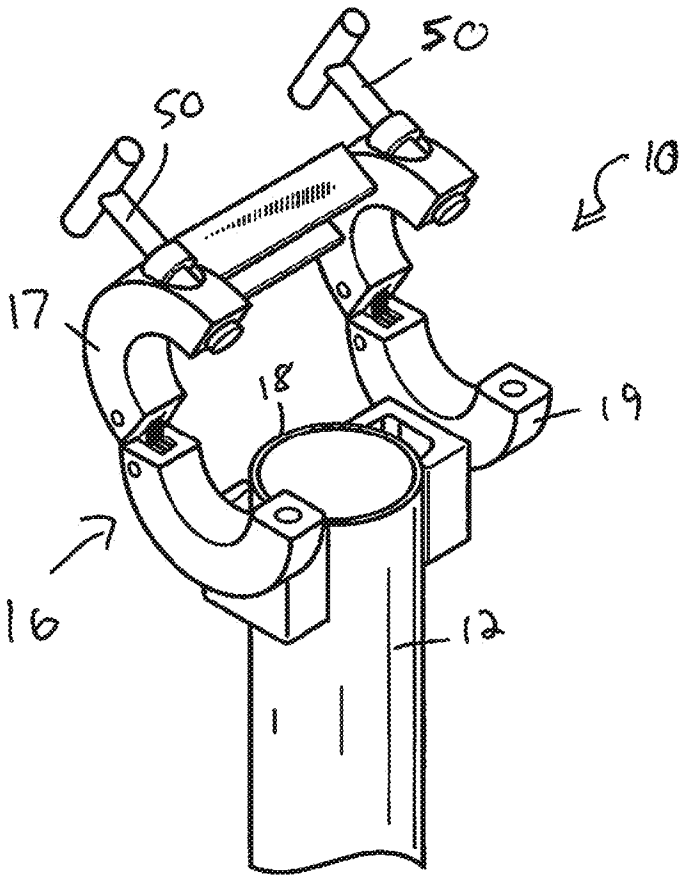
FIGS. 8-9 are perspective views showing another embodiment of the present invention.
Figure 9:
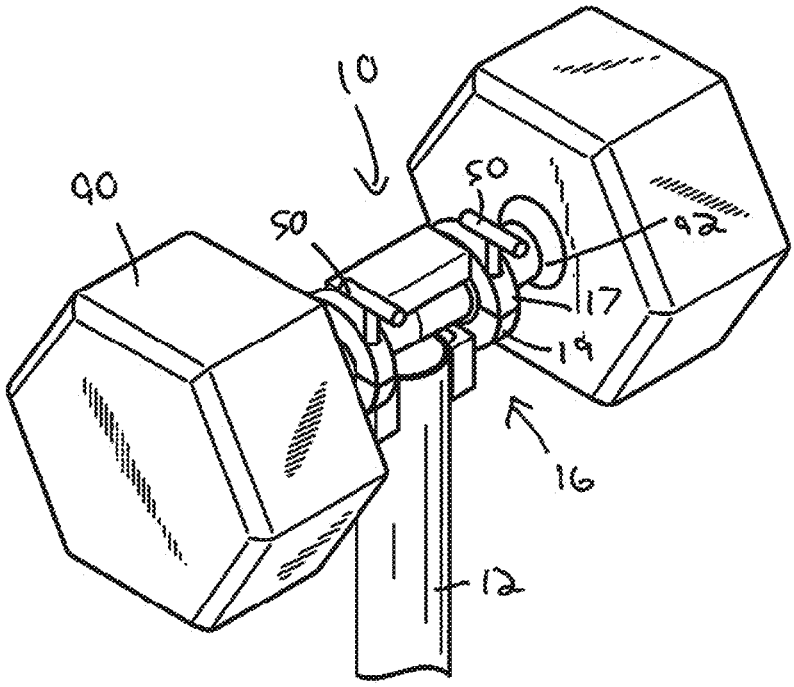
Figure 10:
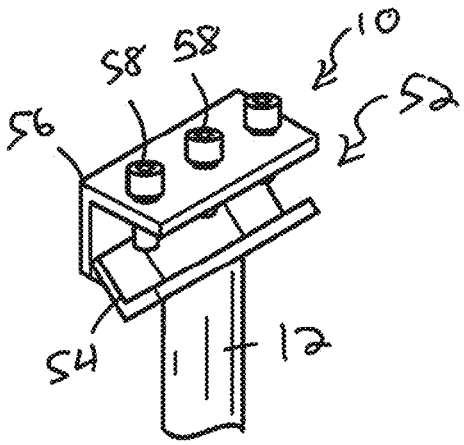
FIGS. 10-19 are perspective views showing additional embodiments of the present invention.
Figure 11:
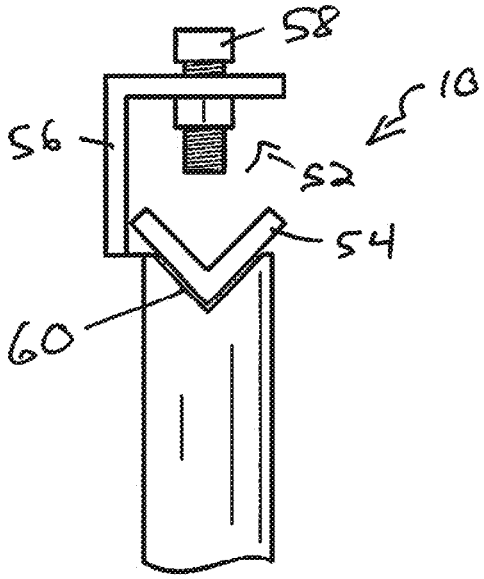
Figure 14:
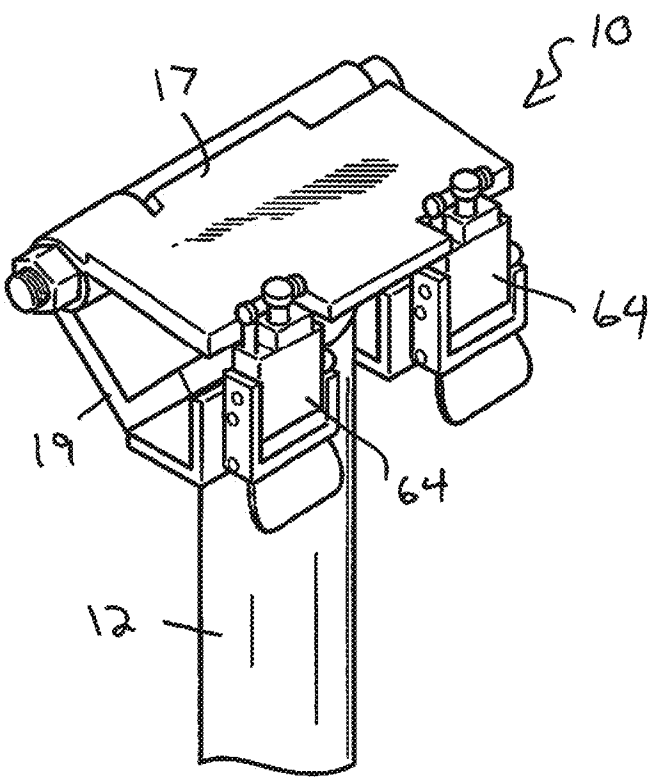
Figure 13:
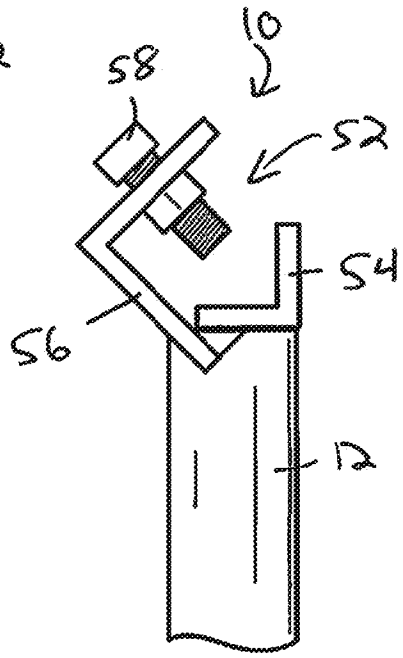
Figure 12:
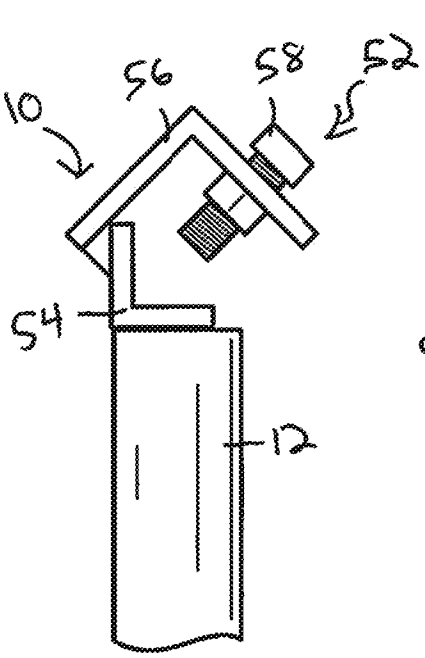
Figure 15:
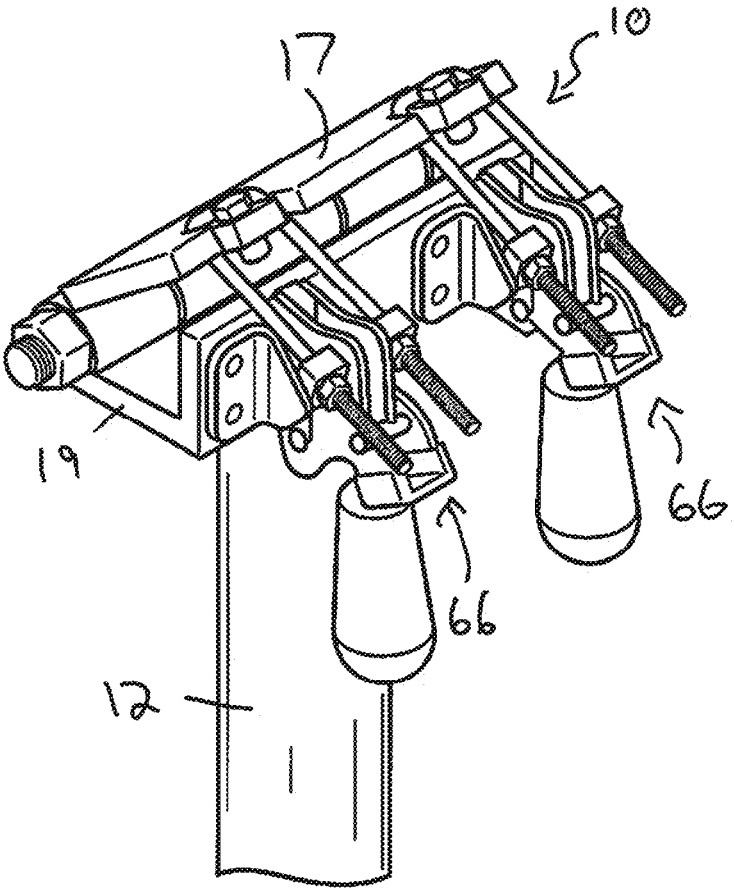
Figure 16:
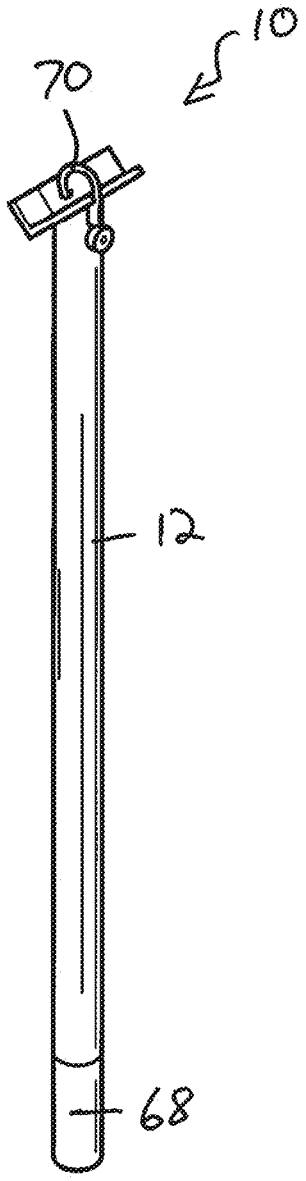
Figure 17:
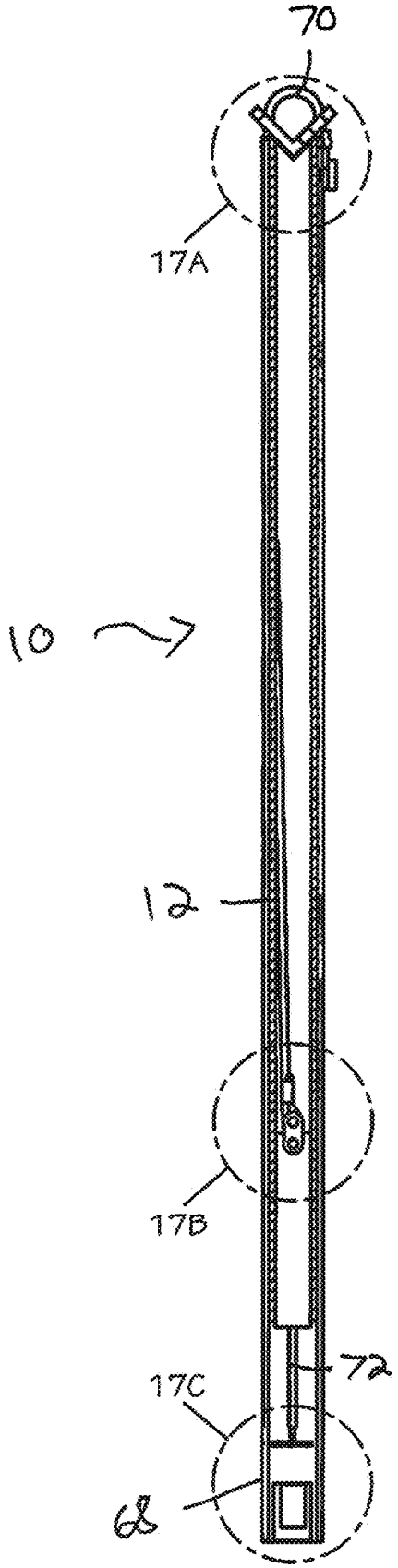
Figure 17A:
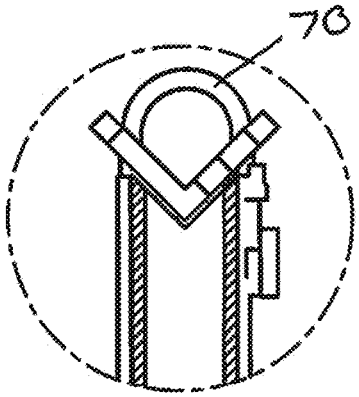
Figure 17B:
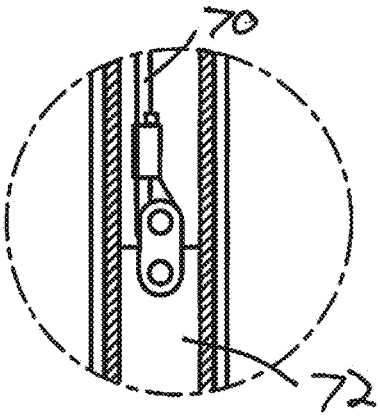
Figure 17C:
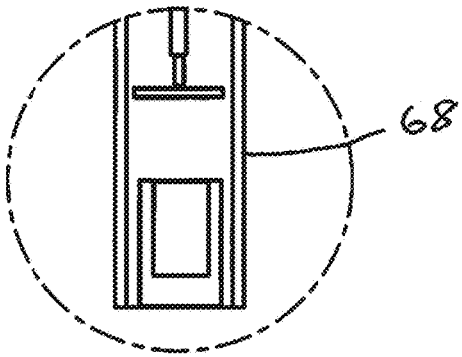
Figure 18:
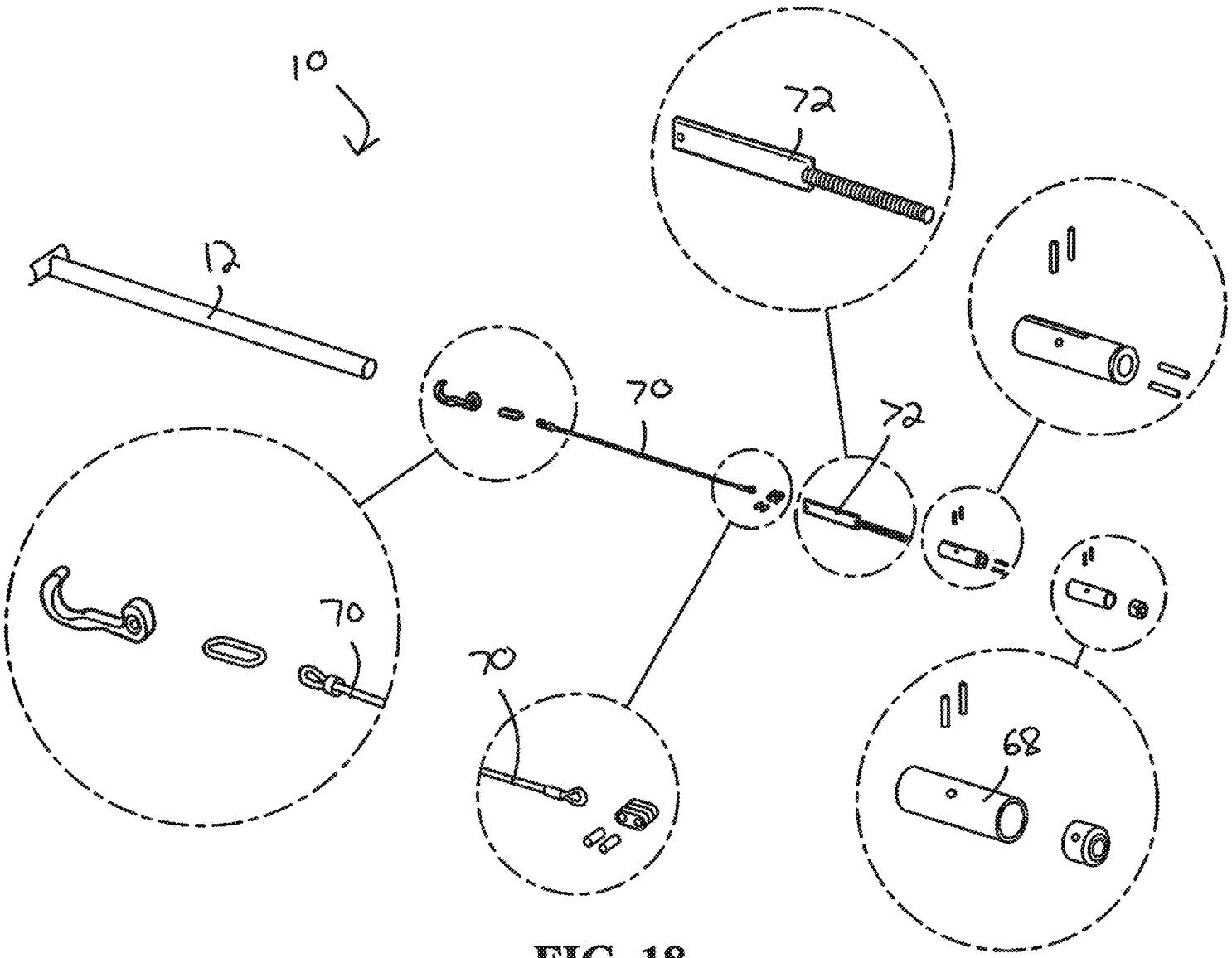
Figure 19:
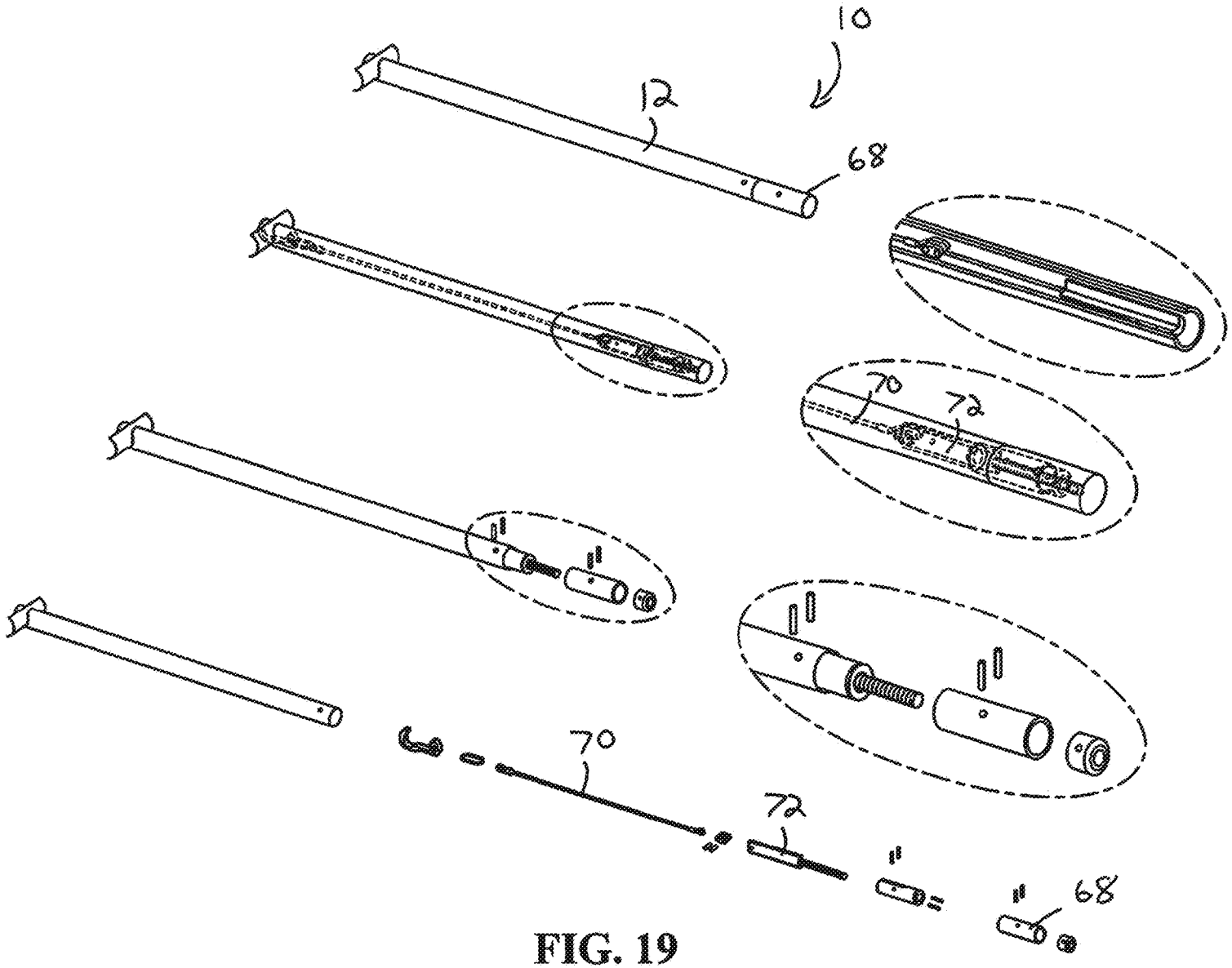
Figure 20:
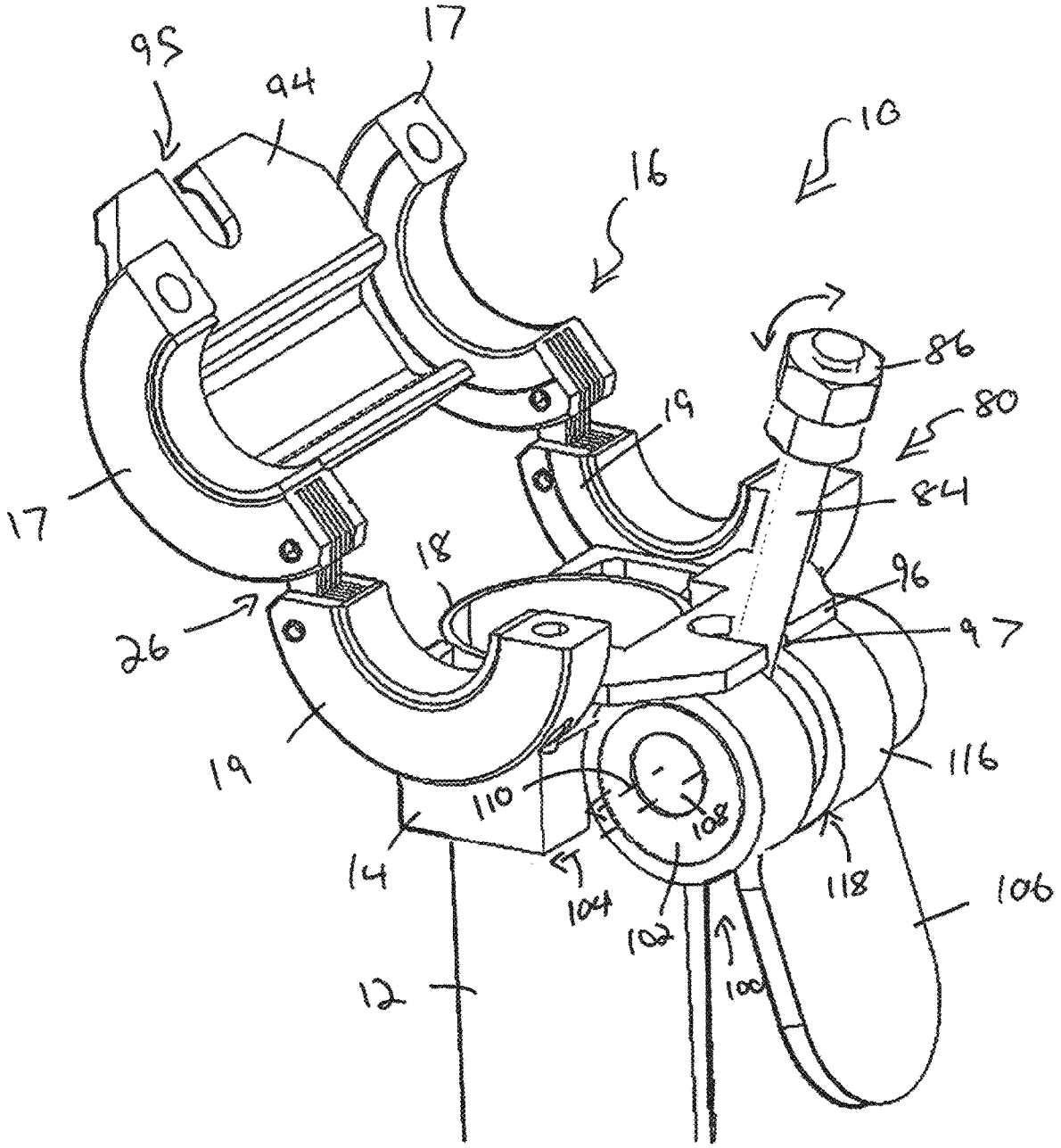
FIG. 20 is a partial perspective view of another embodiment of a sledgehammer workout apparatus of the present invention having a first clamping subassembly and a second clamping subassembly.
Figure 21:
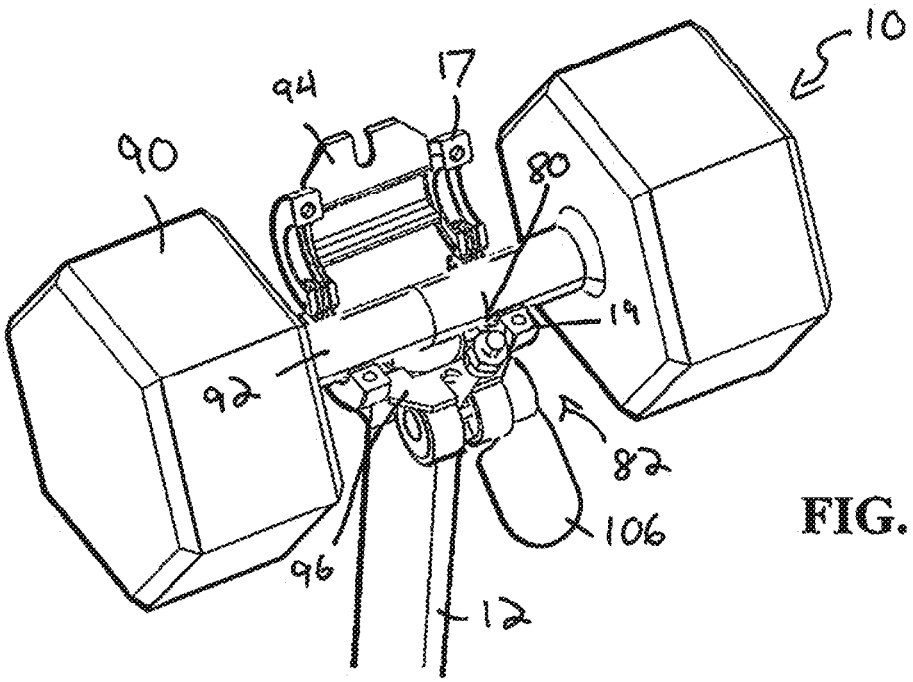
FIG. 21 is a partial perspective view a dumbbell positioned within an open clamping assembly of the apparatus of FIG. 20.

The workout apparatus 10 may include any one of a number of different clamping assemblies. For example, as shown in FIGS. 8 and 9, the clamping assembly 16 may be replaced with clamping assembly 48, which is identical to clamping assembly 16 expect that the threaded bolts 30 have been replaced with tightening fasteners 50. In FIGS. 10-13, clamping assembly 16 has been replaced with clamping assembly 52, which may include v-shaped lower portion 54, L-shaped upper portion 56, and multiple jack screw fasteners 58. Lower portion 54 and upper portion 56 may be welded to the upper portion of handle 12. The upper portion of the handle 12 may be modified to include a v-shaped notch 60 for receiving the v-shaped lower portion 54 in one embodiment (FIG. 11). A similar version without v-shaped notch 60 is shown in FIG. 12. The upper portion of handle 12 may also been modified to include smaller v-shaped notch 62 as shown in FIG. 13. The clamping assembly 16 may be replaced with draw clamp 64 as shown in FIG. 14 or toggle clamp 66 as shown in FIG. 15.

FIGS. 16-19 show a cable pull version of the workout apparatus 10. In this embodiment, the handle 12 includes a rotatable lower portion 68, a cable 70 disposed in the handle 12, a tension rod 72 having one end connected to the cable 70 and an opposite threaded end 74 connected the rotatable lower portion 68. When the rotatable lower portion 68 is rotated in one direction, the tension rod 72 and the cable 70 are pulled in one direction and, when the rotatable lower portion 68 is rotated in an opposite direction, the tension rod 72 and cable 70 are pulled in the opposite direction.

Another embodiment of the adjustable sledgehammer workout apparatus of the present disclosure is shown in FIGS. 20-28. An adjustable sledgehammer workout apparatus 10 for receiving a dumbbell can include a handle 12 having a first end 18. A clamping assembly 16 can include an upper portion 17 and a lower portion 19, the lower portion 17 connected to the first end 18 of the handle 12, the clamping assembly 16 operable to releasably clamp a dumbbell between the upper and lower portions 17 and 19 of the clamping assembly 16. The clamping assembly 16 can include a first clamping subassembly 80 operable to apply a clamping force 88 on the upper and lower portions 17 and 19 of the clamping assembly 16. A second clamping subassembly 82 can be engageable with the first clamping subassembly 80, the second clamping subassembly 82 operable to increase the clamping force 88 applied by the first clamping subassembly 84 on the upper and lower portions 17 and 19 of the clamping assembly 16.

As noted previously, in some embodiments, the upper portion 17 of the clamping assembly 16 can be connected to the lower portion 19 of the clamping assembly 16 via a hinge assembly 26. In some embodiments, the upper and lower portions 17 and 19 of the clamping assembly can include C-shaped upper and lower members 17 and 19 which can be received around a dumbbell handle 92 of a dumbbell 90 positioned within the clamping assembly 16.

In some embodiments, the first clamping subassembly 80 can include a tension rod 84 extendable between the upper and lower portions 17 and 19 of the clamping assembly 16. The first clamping subassembly 80 can also include a fastener 86. The tension rod 84 and fastener 86 can be movable relative to one another to apply a clamping force 88 on the upper and lower portions 17 and 19 of the clamping assembly 16 to initially clamp a dumbbell 90 positioned within the clamping assembly 16. In some embodiments, the tension rod 84 can be at least partially threaded and the fastener 86 can be threadably engageable with the tension rod 84 to move the fastener 86 on the tension rod 84. As such, the tension rod 84 can be extended through the upper and lower portions 17 and 19 of the clamping assembly 16 and the fastener 86 can be tightened on the tensioning rod 84 to clamp the upper and lower portions 17 and 19 of the clamping assembly 16 together.

In some embodiments, the upper portion 17 of the clamping assembly 16 can include a first clamping plate 94 having a first recess 95, and the lower portion 19 of the clamping assembly 16 can include a second clamping plate 96 having a second recess 97. First and second clamping plates 94 and 96 can extend between upper and lower c-shaped members of the upper and lower portions 17 and 19 of the clamping assembly 16 respectively. The tension rod 84 can be sized to be received in the first and second recesses 95 and 97 in the first and second clamping plates 94 and 96 respectively. In some embodiments, the recesses 95 and 97 may be holes through which the tension rod 84 can be passed. In other embodiments, the recess 95 and 97 can be notches defined in a side of the clamping plates 94 and 96 in which the tension rod 84 can be received.

The second clamping subassembly 82 can be operable to increase the clamping force 88 applied to the upper and lower portions 17 and 19 of the clamping assembly 16. For instance in some embodiments, the second clamping subassembly 82 can be configured to produce a force on an end of the tension rod 84 opposite the fastener 86 while one of the upper or lower portions 17 and 19 of the clamping assembly 16 remains stationary. The force applied by the second clamping subassembly 82 can force the upper and lower portions 17 and 19 of the clamping assembly 16 further toward one another, in order to increase the clamping force 88 applied on the upper and lower portions 17 and 19 of the clamping assembly 16, and thus the clamping force 88 applied on a dumbbell 90 positioned within the clamping assembly 16.

In some embodiments, the second clamping subassembly 82 can include a cam assembly 100 mounted adjacent one of the upper or lower portions 17 or 19 of the clamping assembly 16 and coupled to the tension rod 84, the cam subassembly 100 can be operable to apply a force on the tension rod 84 to increase the clamping force applied by the tension rod 84 and the fastener 86 on the upper and lower portions 17 and 19 of the clamping assembly 16. In some embodiments, the cam subassembly 100 can include a cam 102 rotatably disposed on the cam subassembly 100, the cam 102 having a rotational axis 104. A cam handle 106 can extend from the cam 102 in a direction transverse to the rotational axis 104 of the cam 102. Having a cam handle 106 extending in a generally radial direction or transverse direction with respect to a rotational axis of the cam 102 direction from the cam 102 can provide additional leverage from the user when turning the cam 102 to operate the second clamping subassembly 102. The leverage applied via the cam handle 106 can allow the clamping force applied to the upper and lower portions 17 and 19 via the second clamping subassembly 82 to be increased significantly with a smaller input force by the user on the cam handle 106.

In some embodiments, the tension rod 84 can be rotatably coupled to the cam subassembly 82. In some embodiments, the cam subassembly 82 can include a tension rod follower coupling 108 that can be rotatably disposed within the cam 102 and coupled to an end of the tension rod 84. The tension rod 84 can thus be rotatably coupled to the cam subassembly 82 via the tension rod follower coupled 108. A cam housing 116 can be mounted to the handle 12 or the upper or lower portions 17 or 19 of the clamping assembly 16 and the cam 102 can be rotatably disposed in the cam housing 116. The cam housing 116 can include a slot 118 oriented to allow for rotation of the tension rod 84 on the cam subassembly 82. The tension rod follower coupling 108 can have a rotational axis 110 that is not collinear with the rotational axis 102 of the cam 102. As such, as the cam 102 rotates about its rotational axis 104, the tension rod follower coupling 108 can revolve around the rotational axis 104 of the cam 102. As the tension rod follower coupling 108 revolves around the rotational axis 104 of the cam 102, the distance 112 between the tension rod follower coupling 108 and the nearest upper or lower portion 17 or 19 of the clamping assembly 16 can increase when the cam 102 is rotated from an unlocked position (FIG. 28) to a locked position (FIG. 27) via the cam handle 106. The movement of the tension rod follower coupling 108 away from the nearest upper or lower portion 17 and 19 of the clamping assembly 16 applies a force on the tension rod 84 which increases the clamping force 88 applied on the upper and lower portions 17 and 19 of the clamping assembly by the first clamping subassembly 80.

In other embodiments, the cam 102 be an eccentric cam that is not symmetric about its rotational axis 104. The cam 102 can be engaged with a movable upper or lower portion 17 or 19 of the clamping assembly 16. As the cam 102 is rotated via the cam handle 106 between an unlocked and a locked position, a distance between the rotational axis 104 of the cam 102 and the movable upper or lower portion 17 or 19 of the clamping assembly 16 is forced to increase due to the asymmetry of the cam 102. The rotation of the cam 102 forces the movable upper or lower portion 17 or 19 of the clamping assembly 16 to move toward an opposing fixed upper or lower portion 17 or 19 of the clamping assembly 16 to further clamp the upper and lower portions 17 and 19 of the clamping assembly 16 together.

Figure 22:
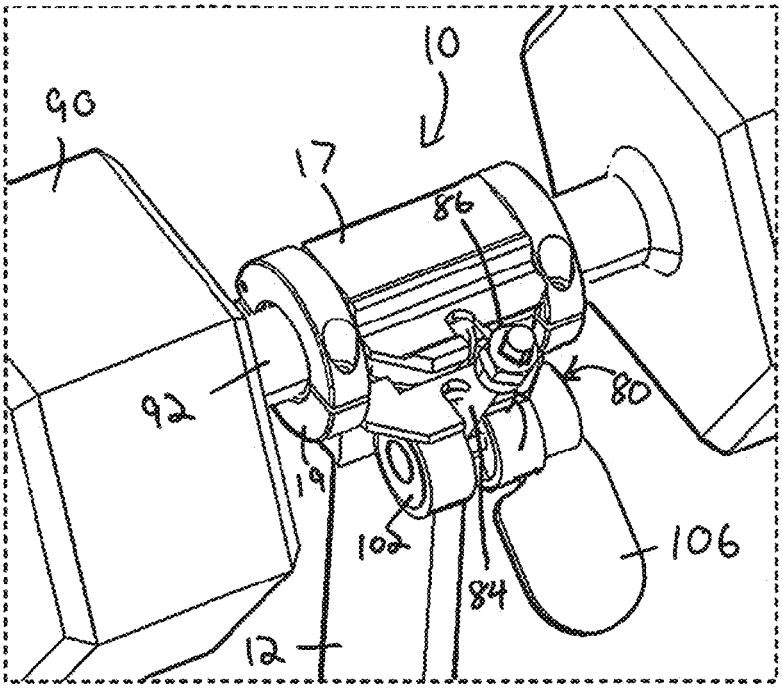
FIG. 22 is a partial perspective view of the apparatus of FIG. 21 with the clamping assembly in a closed position.
Figure 23:
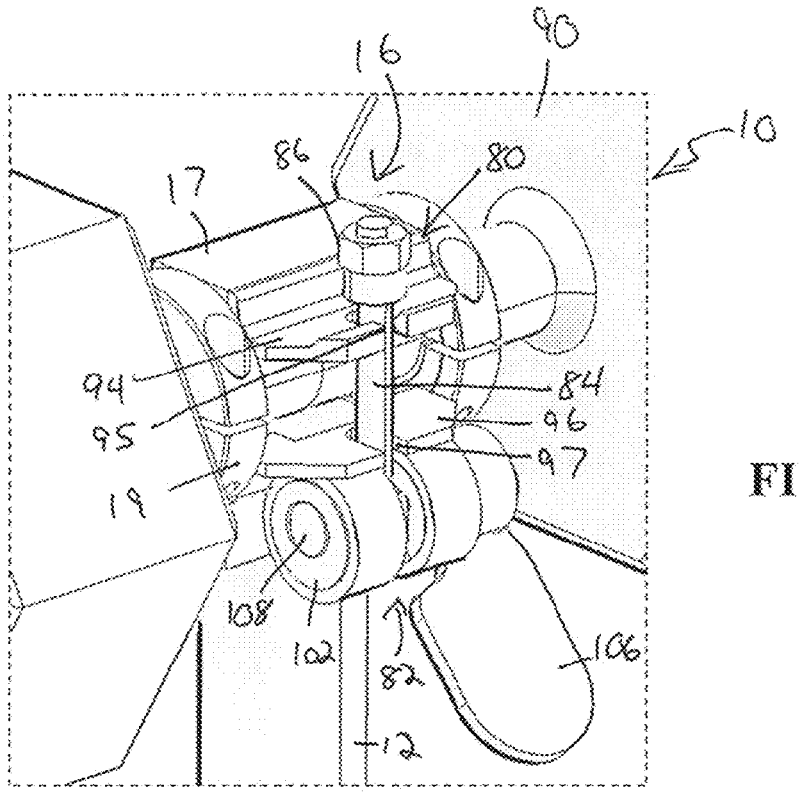
FIG. 23 is a partial perspective view of the apparatus of FIG. 22 with a first clamping subassembly moved into a position to clamp upper and lower portions of the clamping assembly together to clamp the dumbbell within the clamping assembly.
Figure 24:
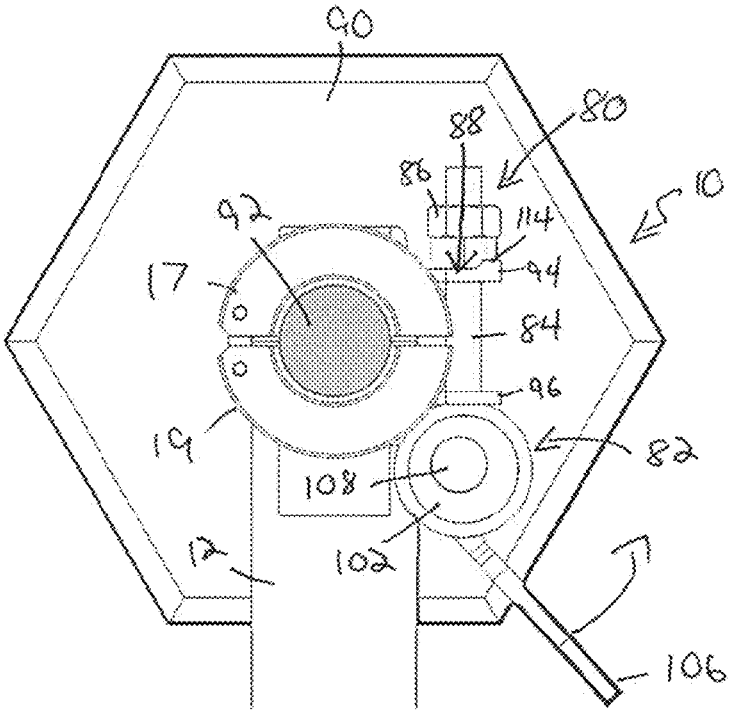
FIG. 24 is a partial cross-section view of the apparatus of FIG. 23 showing the first clamping subassembly applying a clamping force on the upper and lower portions of the clamping assembly.
Figure 25:
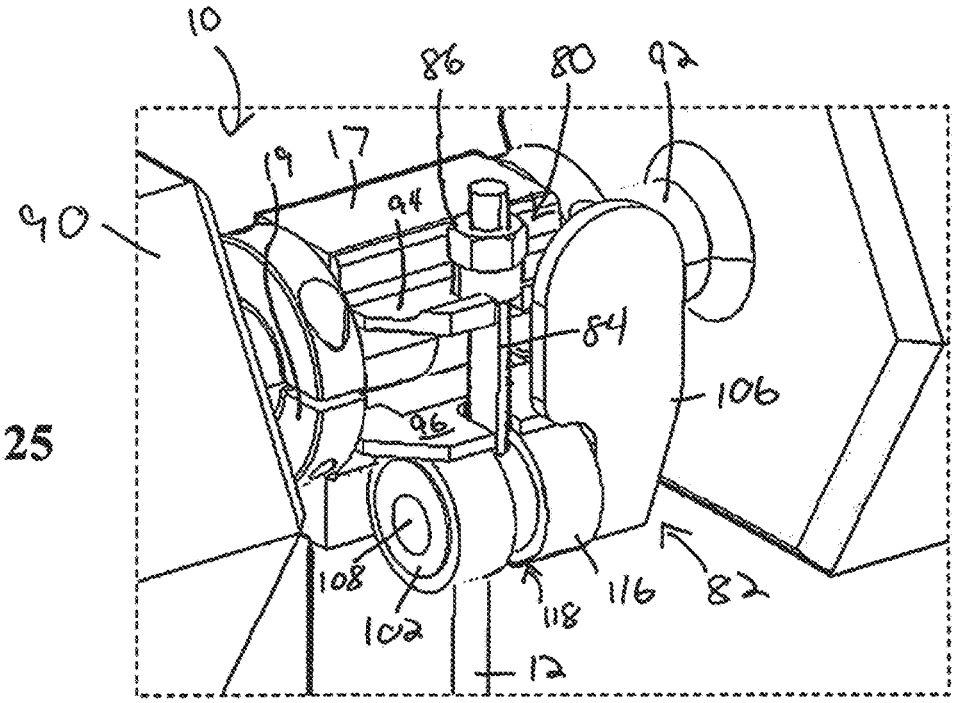
FIG. 25 is a partial perspective view showing a second clamping subassembly of the clamping assembly being operated to apply an additional clamping force on the upper and lower portions of the clamping assembly.
Figure 26:
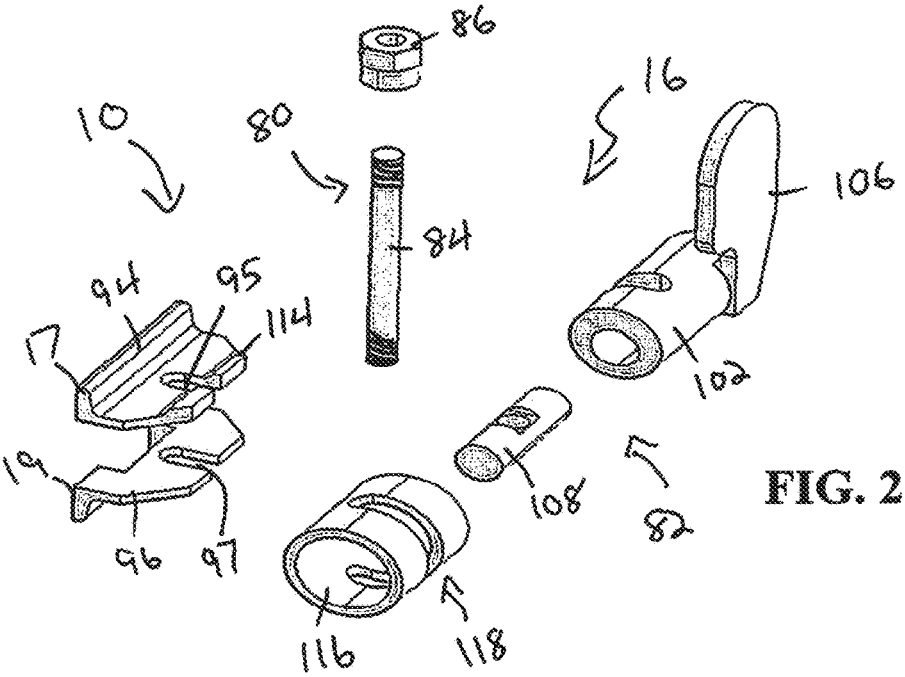
FIG. 26 is an exploded view of the first and second clamping subassemblies of the apparatus of FIG. 25.
Figure 27:
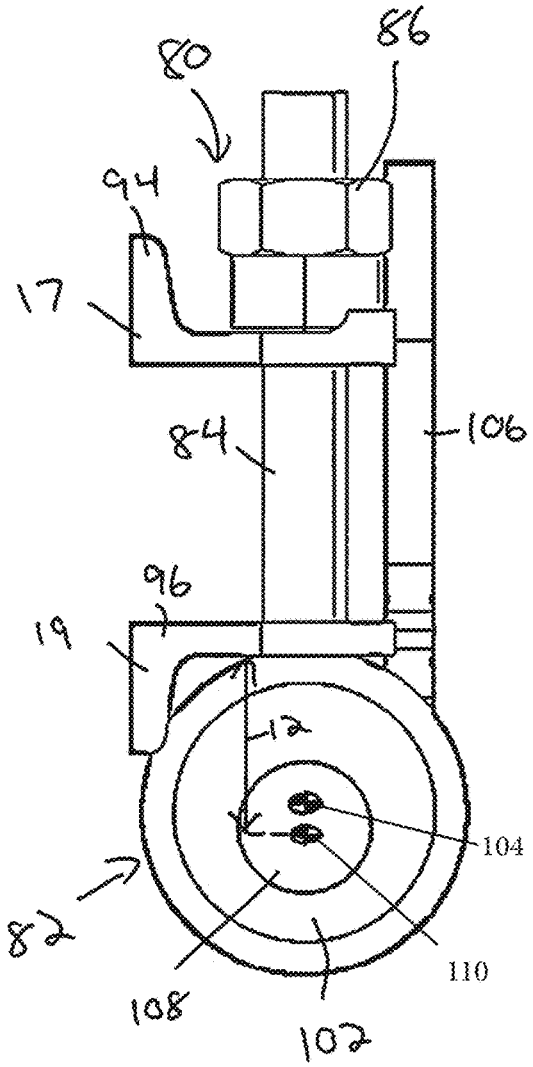
FIG. 27 is a side view of the first and second clamping assemblies of FIG. 25 showing the second subassembly in a locked position.
Figure 28:
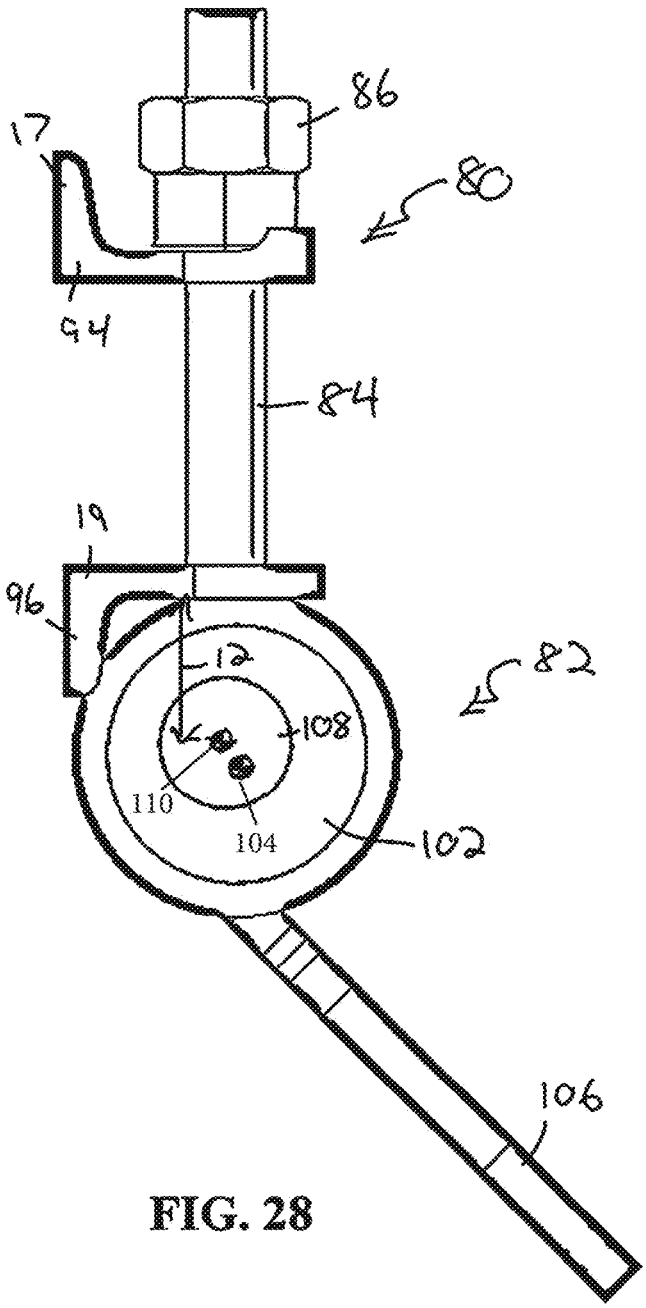
FIG. 28 is a side view of the first and second clamping assemblies of FIG. 25 showing the second subassembly in an unlocked position.

As such, as shown in FIGS. 21-25, with the clamping assembly 16 in an open position, a dumbbell 90 can be positioned with a dumbbell handle 92 of the dumbbell 90 generally positioned within the clamping assembly 16. The upper portion 17 of the clamping assembly 16 can then be moved to a closed position over the dumbbell handle 92 as shown in FIG. 22. The tension rod 84 of the first clamping assembly 80 can then be extend between the upper and lower portions of the clamping assembly, and the fastener 86 can be tightened on the tension rod 84 to provide an initial clamping force between the upper and lower portions 17 and 19 of the clamping assembly. In some embodiments, the fastener 86 can be hand tightened on the tension rod 84. In some embodiments, the tension rod 84 can be rotatably disposed on the second clamping assembly 82 such that the tension rod 84 can be rotated into and out of engagement with the upper portion 17 of the clamping assembly as the dumbbell 90 is being changed out. Notches 95 and 97 in the clamping plates 94 and 96 respectively can allow the tension rod 84 to be rotated on the cam assembly 102 and received in the notches 95 or 97. In some embodiments, the upper clamping plate 94 can have a distal end 114 that is curved or bent in an upward direction. The upwardly extending distal end of the upper clamping plate 94 can facilitate retention of the tension rod 84 and fastener 86 on the upper clamping plate 94 when the tension rod 84 is received in the notches or recesses 95 and 97 of the clamping plates 94 and 96 and the fastener 86 is tightened on the tension rod 84.

With the first clamping subassembly 80 in a tightened position and applying an initial clamping force, a user can then actuate the second clamping subassembly 82 by turning cam handle 106 to apply an additional force on the first clamping subassembly 80 and/or move the upper and lower portions 17 and 19 of the camping assembly closer together. The additional clamping force and/or movement of upper or lower portions 17 or 19 of the clamping assembly 16 can further clamp the dumbbell handle 92 within the clamping assembly 16.

Thus, although there have been described particular embodiments of the present invention of a new and useful ADJUSTABLE SLEDGEHAMMER WORKOUT APPARATUS, it is not intended that such references be construed as limitations upon the scope of this invention.

What is claimed is:

1. An adjustable sledgehammer workout apparatus for receiving a dumbbell, the apparatus comprising:

a handle having a first end;

a clamping assembly including an upper portion and a lower portion, the lower portion connected to the first end of the handle, the clamping assembly operable to releasably clamp the dumbbell between the upper and lower portions of the clamping assembly, wherein the clamping assembly includes:

a first clamping subassembly operable to apply a clamping force on the upper and lower portions of the clamping assembly; and a second clamping subassembly engageable with the first clamping subassembly, the second clamping subassembly operable to increase the clamping force applied by the first clamping subassembly on the upper and lower portions of the clamping assembly.

2. The apparatus of claim 1, wherein the upper portion of the clamping assembly is connected to the lower portion of the clamping assembly via a hinge assembly.

3. The apparatus of claim 1, further comprising a rubber pad positionable between the dumbbell and at least one of the upper portion or the lower portion of the clamping assembly.

4. The apparatus of claim 3, wherein the rubber pad is wrappable around the dumbbell such that when the dumbbell is clamped between the upper and lower portions of the clamping assembly, both the upper and lower portions of the clamping assembly are clamped against the rubber pad.

5. The apparatus of claim 1, wherein the first clamping subassembly further comprises:

a tension rod extendable between the upper and lower portions of the clamping assembly; and a fastener, wherein the tension rod and the fastener are movable relative to one another to apply the clamping force on the upper and lower portions of the clamping assembly.

6. The apparatus of claim 5, wherein the tension rod is at least partially threaded, and the fastener is threadably engageable with the tension rod to move the fastener on the tension rod.

7. The apparatus of claim 5, wherein:

the upper portion of the clamping assembly includes a first clamping plate having a first recess;

the lower portion of the clamping assembly includes a second clamping plate having a second recess; and the tension rod is sized to be received in the first and second recesses in the first and second clamping plates, respectively.

8. The apparatus of claim 5, wherein the second clamping subassembly is a cam subassembly mounted adjacent to one of the upper or lower portions of the clamping assembly and coupled to the tension rod, the cam subassembly operable to apply a force on the tension rod to increase the clamping force applied by the tension rod and the fastener on the upper and lower portions of the clamping assembly.

9. The apparatus of claim 8, wherein the cam subassembly further comprises:

a cam rotatably disposed on the cam subassembly, the cam having a rotational axis; and a cam handle extending from the cam in a direction transverse to the rotational axis of the cam.

10. The apparatus of claim 8, wherein the tension rod is rotatably coupled to the cam subassembly.

11. The apparatus of claim 1, wherein:

the first end of the handle has a first lateral side and a second lateral side opposite the first lateral side; and the lower portion of the clamping assembly has a first lower portion member mounted to the first lateral side of the first end of the handle and a second lower portion member mounted to the second lateral side of the first end of the handle.

12. An adjustable sledgehammer workout apparatus for receiving a dumbbell having a dumbbell handle and two weighted ends, the apparatus comprising:

an apparatus handle having a first end;

a clamping assembly mounted to the first end of the apparatus handle, the clamping assembly operable to releasably clamp the dumbbell handle of the dumbbell within the clamping assembly, the clamping assembly including:

an upper portion and a lower portion, the lower portion connected to the first end of the handle, the clamping assembly operable to releasably clamp the dumbbell between the upper and lower portions of the clamping assembly;

a first clamping subassembly including a tension rod extendable between the upper and lower portions of the clamping assembly, and a fastener, wherein the tension rod and the fastener are movable relative to one another to apply a clamping force on the upper and lower portions of the clamping assembly; and a second subassembly operable to apply a force on the tension rod to increase the clamping force applied on the upper and lower portions of the clamping assembly by the first clamping subassembly.

13. The apparatus of claim 12, wherein the second clamping subassembly includes a cam assembly coupled to the tension rod.

14. An adjustable sledgehammer workout apparatus for receiving a dumbbell, the dumbbell having a dumbbell handle and two weighted ends, the apparatus comprising:

an apparatus handle having a first end;

a clamping assembly operable to releasably clamp the dumbbell handle within the clamping assembly, the clamping assembly including:

a first side clamp having a first lower portion and a first upper portion;

a second side clamp having a second lower portion and a second upper portion, the first lower portion mounted to a first side location of the first end of the apparatus handle, the second lower portion mounted to a second opposite side location of the first end of the apparatus handle;

a first clamping plate extending between the first and second upper portions of the first and second side clamps, respectively;

a second clamping plate extending between the first and second lower portions of the first and second side clamps, respectively;

a first clamping subassembly operable to apply a clamping force on the first and second clamping plates of the clamping assembly; and a second clamping subassembly engageable with the first clamping subassembly, the second clamping subassembly operable to increase the clamping force applied by the first clamping subassembly on the first and second clamping plates of the clamping assembly.

15. The apparatus of claim 14, wherein the first lower portion and the first upper portion are pivotally connected together, and the second lower portion and the second upper portion are pivotally connected together.

16. The apparatus of claim 14, wherein the first clamping subassembly further comprises:

a tension rod extendable between the first and second clamping plates of the clamping assembly; and a fastener, the tension rod and fastener movable relative to one another to apply a clamping force on the first and second clamping plates of the clamping assembly.

* * * * *